US005473418A

United States Patent [19]

Kazakos et al.

[11] Patent Number: 5,473,418

[45] Date of Patent: Dec. 5, 1995

[54] CERAMIC COATING COMPOSITION FOR A HYBRID SCAVENGELESS DEVELOPMENT DONOR ROLL

[75] Inventors: Ann M. Kazakos, Webster; Daniel R. Gilmore, III, Victor, both of N.Y.

[73] Assignee: Xerox Corporation, Stamford, Conn.

[21] Appl. No.: 360,476

[22] Filed: Dec. 21, 1994

[51] Int. Cl.[6] ..... G03G 15/06

[52] U.S. Cl. ..... 355/259; 355/247; 118/654; 492/18; 492/28; 492/60

[58] Field of Search ..... 355/259, 261, 355/245, 247; 118/653, 654, 647; 492/18, 28

[56] References Cited

U.S. PATENT DOCUMENTS

| | | | |
|---|---|---|---|
| 5,245,392 | 9/1993 | Behe et al. | 355/259 |
| 5,322,970 | 6/1994 | Behe et al. | 355/259 X |
| 5,384,627 | 1/1995 | Behe et al. | 355/247 |

*Primary Examiner*—R. L. Moses

[57] ABSTRACT

A donor roll having a ceramic coating for use with an electrode structure in a scavengeless development unit of an electrostatographic printer. The ceramic coating consist essentially of a suitable mixture of alumina and titania by weight giving the donor roll a desired resistivity within a range of $2.0\times10^7$–$4.2\times10^8$ (Ohm-cm), a discharge time constant of about 550 microseconds, and a dielectric constant within a range of 16–24 at 100.KHz.

14 Claims, 5 Drawing Sheets

| % BY WEIGHT OF AT-87 AND AT-60 | % BY WEIGHT OF EACH CERAMIC MATERIAL |
|---|---|
| 90% AT-87/10% AT-60 | 84% $Al_2O_3$/16% $TiO_2$ |
| 93% AT-87/ 7% AT-60 | 85% $Al_2O_3$/15% $TiO_2$ |
| 95% AT-87/ 5% AT-60 | 85.6% $Al_2O_3$/14.4% $TiO_2$ |
| 97% AT-87/ 3% AT-60 | 86.2% $Al_2O_3$/13.8% $TiO_2$ |
| 100% AT-87 | 87% $Al_2O_3$/13% $TiO_2$ |

FIG. 3

| % BY WEIGHT OF AT-87 AND AT-60 | % BY WEIGHT OF EACH CERAMIC MATERIAL | % BY WEIGHT OF EACH CERAMIC MATERIAL AFTER NORMALIZATION* |
|---|---|---|
| 90% AT-87/ 10% AT-60 | 84.43% $Al_2O_3$/ 14.38% $TiO_2$ | 85.45% $Al_2O_3$/ 14.55% $TiO_2$ |
| 93% AT-87/ 7% AT-60 | 85.52% $Al_2O_3$/ 13.33% $TiO_2$ | 86.52% $Al_2O_3$/ 13.48% $TiO_2$ |
| 95% AT-87/ 5% AT-60 | 86.25% $Al_2O_3$/ 12.63% $TiO_2$ | 87.22% $Al_2O_3$/ 12.78% $TiO_2$ |
| 97% AT-87/ 3% AT-60 | 86.98% $Al_2O_3$/ 11.94% $TiO_2$ | 87.94% $Al_2O_3$/ 12.07% $TiO_2$ |
| 100% AT-87/ 0% AT-60 | 88.07% $Al_2O_3$/ 10.89% $TiO_2$ | 89.00% $Al_2O_3$/ 11.00% $TiO_2$ |

FIG. 4

CERAMIC COATING COMPOSITION FOR A HYBRID SCAVENGELESS DEVELOPMENT DONOR ROLL

BACKGROUND OF THE INVENTION

The present invention relates to a development apparatus for electrostatographic printing machines. More specifically, the present invention relates to a particular composition for a ceramic coated donor roll for use in a hybrid scavengeless development apparatus.

Generally, the process of electrostatographic reproduction includes uniformly charging a photoconductive member, or photoreceptor, to a substantially uniform potential, and imagewise discharging it or imagewise exposing it to light reflected from an original image being reproduced. The result is an electrostatically formed latent image on the photoconductive member. The latent image so formed is developed by bringing a charged developer material into contact therewith. Twocomponent and single-component developer materials are commonly used. A typical two-component developer material comprises magnetic carrier particles, having charged toner particles adhering triboelectrically thereto. A single component developer material typically comprises charged toner particles only. In either case, the charged toner particles when brought into contact with the latent image, are attracted to such image, thus forming a toner image on the photoconductive member. The toner image is subsequently transferred to a receiver sheet which is then passed through a fuser apparatus where the toner image is heated and permanently fused to the sheet, thus forming a hard copy of the original image.

To develop a latent image in an electrostatographic reproduction machine as above, charged toner particles either alone (single component), or mixed (two-component), are brought, by a development apparatus, into contact with the latent image formed on the photoreceptor. For two-component development, developer material containing carrier particles and toner particles is used. The development apparatus for such development typically includes a housing defining a chamber within which the developer material is mixed and charged. Moving and mixing two-component developer material triboelectrically and oppositely charges the carrier particles and the toner particles causing the toner particles to adhere to the carrier particles.

As disclosed for example in U.S. Pat. No. A-5,245,392, and USSN#07/091858 both assigned to the assignee of the present application, one type of a two-component development method and apparatus is referred to as "hybrid scavengeless development", and is very suitable for image-on-image development type processes. The apparatus includes a housing defining a development zone, and a mixing chamber holding developer material containing carrier and toner particles. The apparatus also includes a developer material transport roll and a donor member such as a donor roll for receiving charged toner particles from the developer material transport roll and transporting them to the development zone. A plurality of electrode wires are embedded in, or are closely spaced relative to, the donor roll within the development zone. An AC voltage is applied to the electrode wires for forming a toner cloud in the development zone. Electrostatic fields generated by an adjacent latent image on a photoreceptor surface serve to attract charged toner particles from the toner cloud, thus developing the latent image.

Single component development systems, referred to as jumping gap development, can also use a donor roll for transporting charged toner particles directly from a toner chamber to the development zone. The charged toner particles similarly are attracted by and develop an electrostatic latent image recorded on a photoconductive surface. In jumping gap development, an AC voltage is applied to the donor roll for detaching toner particles from the donor roll and projecting them toward an adjacent photoconductive surface holding the electrostatic latent image.

In either of the above discussed development systems for example, the donor member or roll and its electrical and chemical characteristics are very important to the ability of the development apparatus repeatably transport acceptable and uniform quantities of toner particles into the development zone, as well as effective support the electrostatic fields necessary within the development zone for high quality image development. For example, the donor roll must be suitable for charged toner particles to effectively and controllably (even at high speeds) adhere electrostatically thereto. The surface of the donor roll must be partially conductive relative to a more conductive core, and this partial conductivity on the surface should be uniform throughout the entire circumferential surface area. The range of conductivity of a donor roll should be well chosen in order to maximize the efficiency of a donor roll in view of any number of designed parameters, such as energy consumption, mechanical control and the discharge time-constant of the surface thereof.

In image-on-image type processes with a pre-developed toner image already on the photoreceptor, the donor roll should also act as an electrostatic "intermediate" between the photoreceptor and the developer transport roll in order to minimize unwanted interactions between the development system and the photoreceptor. Minimizing such interactions is particularly desirable in such processes because the single photoreceptor therein is to be charged, exposed and developed several times usually in a single, as in single pass highlight color process or in a single pass full color process.

The donor roll must further have desirable wear-resistant properties so that the surface thereof will not be readily abraded by adjacent surfaces. Further, the surface of the donor roll should be without anomalies such as pin holes, which may be created in the course of its manufacture. Pinholes created in the manufacturing process or abrasions caused in its use, can result in electrostatic "hot spots" and undesirable electrical arcing in the vicinity of such structural imperfections. Ultimately, the most important requirement of the donor roll can be summarized by the phrase "uniform conductivity;" Other physical properties of the donor roll, such as the mechanical adhesion of toner particles, are also important, but are generally not as quantifiable in designing development apparatus.

As disclosed for example in each of the following references, particular attempts have been disclosed for providing donor rolls with specific features and characteristics towards meeting some of the requirements as stated above.

For example, U.S. Pat. No. -A-3,950,089 discloses a development apparatus in which a surface for the direct conveyance of electrically-conductive toner comprises a dielectric sheath of a thickness of 1–25 mils, having a resistivity of $10^7$ to $10^9$ ohm-cm.

U.S. Pat. No. -A-4,034,709 discloses a development apparatus in which asurface for the direct conveyance of toner comprises styrene-butadiene, of a resistivity of $10^2$ to $10^6$ ohm-cm.

U.S. Pat. No. -A-4,774,541 discloses a development apparatus in which a surface for the direct conveyance of toner is doped with carbon black to a conductivity of $10^{-6}$ to $10^{-10}$ 1ohm-cm.

Co-pending application Ser. No. 07/955,965, filed Oct. 2, 1992, discloses a phenolic resin coated on a donor roll. The use of phenolic resin coated donor rolls results in discharge time constants less than 300 microseconds.

In the prior art, there are a few instances in which the physical properties of ceramics are exploited for various purposes relating to development of electrostatic latent images.

U.S. Pat. No. -A-4,544,828 discloses a heating device utilizing ceramic particles as a heat source and adapted for use as a fixing apparatus.

U.S. Pat. No. -A-4,893,151 discloses a single component image developing apparatus including a developing roller coated with a Chemical Vapor Deposition ceramic and an elastic blade coated with a ceramic.

SUMMARY OF THE INVENTION

In accordance with one aspect of the present invention, there is provided a toner transport roll having a ceramic outer surface coating for transporting toner particles from a supply of developer material into a development transfer relationship with a latent image. The ceramic coating of the donor roll consists essentially of a mixture of a particular percent Alumina ($Al_2O_3$) and the remainder of Titania ($TiO_2$), by weight.

In accordance with another aspect of the present invention, there is provided a toner transport roll having a ceramic outer surface coating for transporting toner particles from a supply of developer material into a development transfer relationship with a latent image. The ceramic coating of the donor roll consists of 83%–87% alumina ($Al_2O_3$) and 13%–17% Titania ($TiO_2$), by weight.

In accordance with a further aspect of the present invention, there is provided an apparatus for developing a latent electrostatic image on a surface. The apparatus includes a housing that defines a chamber storing a supply of developer material containing charged toner particles, and a device mounted partially within the chamber for moving the developer material. The apparatus also includes a donor roll having a ceramic outer surface coating for transporting toner particles from the developer material moving device into a development transfer relationship with the latent image. The ceramic coating of the donor roll consists of 83%–87% alumina ($Al_2O_3$) and 13%–17% titania ($TiO_2$), by weight.

Other features of the present invention will become apparent from the following drawings and description.

BRIEF DESCRIPTION OF THE DRAWINGS

Other features of the present invention will become apparent as the following description precedes and upon reference to the drawings, in which:

FIG. 3 is a table of various combinations of a percentage of one batch of AT-87 and that of one batch of AT-60 powders, and the resulting composition;

FIG. 4 is another table of various combinations of a percentage of another batch of AT-87 and that of another batch of AT-60 powders, and the resulting composition normalized for 1–2% of other oxides;

Figure 1:
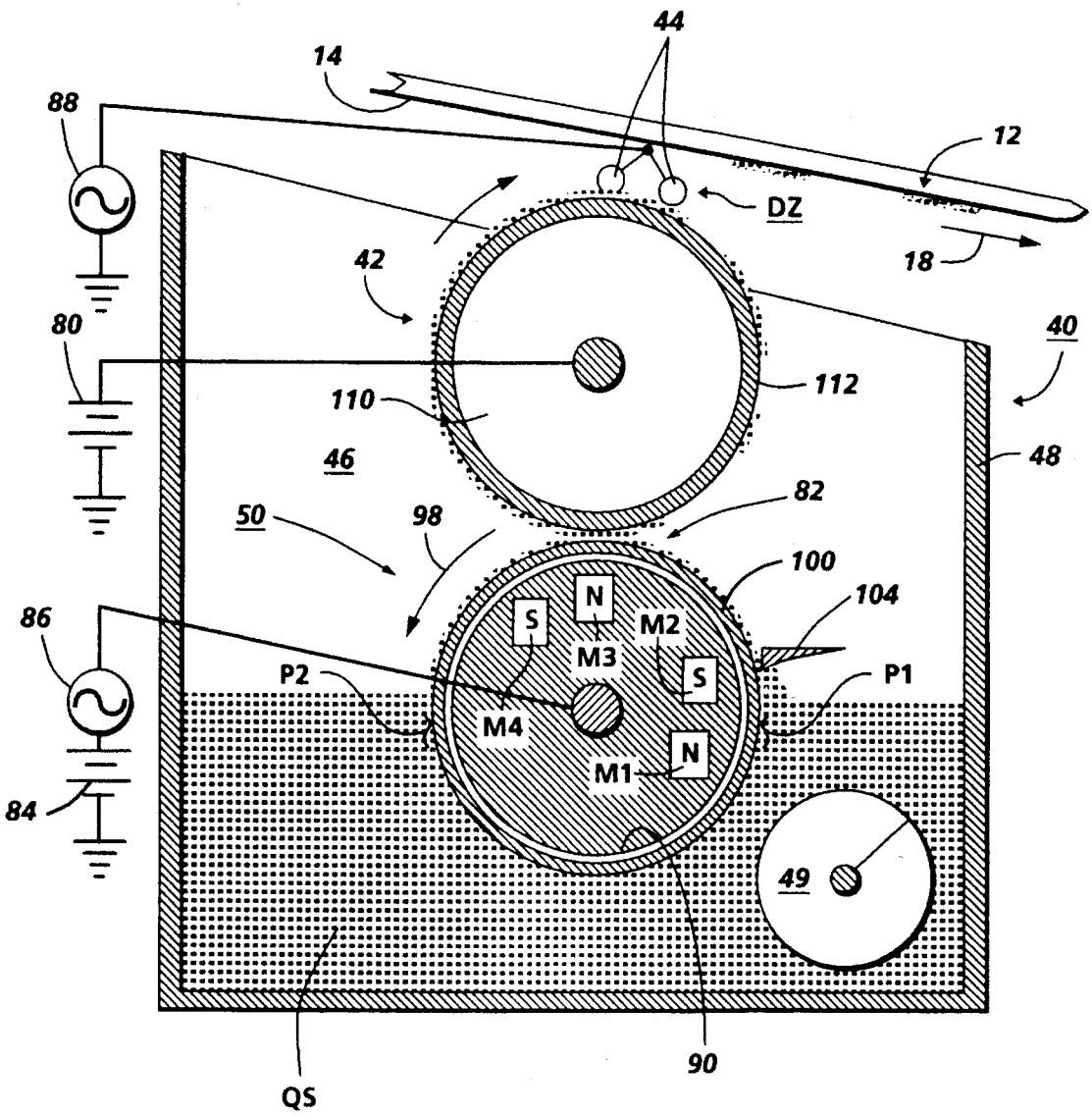
FIG. 1 is a schematic elevational view of an embodiment of a two component development apparatus including the donor roll according to the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Inasmuch as the art of electrostatographic reproduction is well known, the various processing stations employed in an exemplary electrostatographic reproduction machine will be shown hereinafter schematically, and their operations described only briefly.

Referring initially to FIG. 3, there is shown an exemplary electrostatographic printing machine 10 incorporating the development apparatus of the present invention. The electrostatographic printing machine 10 for example employs a belt type image bearing member 12 having a photoconductive surface 14 formed over an electrically grounded conductive substrate 16. One skilled in the art, however, will appreciate that another suitable arrangement of a photoconductive image bearing member, such as a drum having a photoconductive surface, may be used. As shown, belt 12 moves in the direction of arrow 18 to advance successive portions of photoconductive surface 14 sequentially through the various processing stations disposed about the path of movement thereof. Belt 12 is entrained about stripping roller 20, tensioning roller 22, and drive roller 24. Drive-roller 24 is mounted rotatably in engagement with belt 12. Motor 26 is coupled to, and rotates roller 24 in order to advance belt 12 in the direction of arrow 18. Belt 12 is maintained in tension by a suitable pair of springs (not shown) resiliently urging tensioning roller 22 against belt 12 with a desired spring force. Stripping finger 20 and tensioning roller 22 are mounted to rotate freely.

Initially, a portion of belt 12 passes through charging station SA where a corona generating device, indicated generally by the. reference numeral 28, charges photoconductive surface 14 to a relatively high, and substantially uniform potential. High voltage power supply 30 is coupled to corona generating device 28, and excitation of the power supply 30 causes corona generating device 28 to charge a portion of the photoconductive surface 14 of belt 12. After such charging, the charged portion is advanced, as belt 12 is moved, to exposure station SB.

At exposure station SB, lamps 36 flash light rays for reflection onto an original document 32 that is placed face down upon a transparent platen 34. The light rays reflected imagewise from the original image of document 32 are transmitted through lens 38 to form a light image thereof. Lens 38 focuses the imagewise light rays onto the charged portion of photoconductive surface 14 at exposure station SB and thus selectively dissipates the charge thereon to form a latent image. The latent image thus formed on photoconductive surface 14 corresponds to the informational areas contained within the original image of document 32. For such image wise exposure of photoconductive surface 14, a raster output scanner (ROS) (not shown) may alternatively be used in lieu of the lamps and light lens system previously described. As is well known, the ROS can be used as such to layout an image in a series of horizontal scan lines with each line having a specified number of pixels per inch.

After the electrostatic latent image has been formed thus on photoconductive surface 14, belt 12 advances the latent image to development station SC. At development station SC, the development apparatus of the present invention, indicated generally by the reference numeral 40, (to be described in detail below) develops the latent image recorded on the photoconductive surface 14 to form a toner image. Belt 12 then advances the toner image to transfer station SD where a copy sheet 54 is advanced by sheet feeding apparatus 56 into a transfer relation with the toner image. Preferably, sheet feeding apparatus 56 includes a feed roll 58 contacting the uppermost sheet of a stack 60 of such sheets. Transfer station SD also includes a corona generating device 64 which sprays ions onto the back side of sheet 54 to attract the toner image from photoconductive surface 14 onto sheet 54. After such image transfer, sheet 54 is separated from the belt 12 and moved in the direction of arrow 66 onto a conveyor (not shown) which advances sheet 54 to fusing station SE.

As shown, fusing station SE includes a fuser assembly indicated generally by the reference numeral 68 that has a pair of fusing rolls. The fusing assembly rolls 68 preferably include a heated fuser roller 70 and a back-up pressure roller 72. Sheet 54 is passed between fuser roller 70 and back-up roller 72 so that the toner image thereon contacts heated fuser roller 70. In this manner, the toner image is heated, fused and permanently affixed to sheet 54 forming a sheet copy of the original image of document 32. The sheet copy now on sheet 54 is then advanced through a chute 74 to a catch tray 76 for subsequent removal from the reproduction machine 10.

Meanwhile, belt 12 next moves the portion of the surface 14 from which the image had been transferred to the copy sheet 54 to a cleaning station SF where residual toner particles are cleaned or removed. Cleaning station SF, for example, includes a rotatably mounted fibrous brush 78 that rotates in contact with photoconductive surface 14 for cleaning by removing the residual toner particles. Subsequent to such cleaning, a discharge lamp (not shown) floods photoconductive surface 14 with light in order to dissipate any residual electrostatic charge remaining thereon from the prior imaging cycle.

Typically, the speed of such electrostatographic printing or reproduction machines is measured in terms of a number of sheet copies produced per unit time. Among different families of such machines, speed therefore varies significantly from a low between 10 and 20 copies per minute to a high of greater than 100 copies per minute. For such machines to produce high quality copies or reproductions of original images, the processing stations (including the development station SC), must be designed so as to function effectively at a desired speed of the machine. For example, the development station SC therefore must be capable of functioning as such, even at substantially high machine speeds, to repeatably deliver a uniform, desired quantity of toner particles to the development zone for latent image development.

It is believed that the foregoing description is sufficient for purposes of the present application to illustrate the general operation of an electrostatographic reproduction machine incorporating the development apparatus of the present invention.

Referring now to FIG. 1, there is shown a two-component embodiment of the development apparatus 40 of the present invention. The development apparatus 40 includes the improved donor roll 42 according to the present invention for enabling an effective and repeatable delivery of a uniform, desired quantity of toner particles for latent image development. As shown, development apparatus 40 includes the movable donor roll 42 (to be described in detail below) that is mounted, at least partially, within a mixing chamber 46. Mixing chamber 46 is defined by housing 48, and holds a supply QS of developer material consisting of toner particles and carrier beads. The donor member 42 is moved to transport toner particles fed from the chamber 46 into contact with cloud producing electrode wires 44 within the development zone DZ for latent image development. The developer material QS typically is a two-component developer material comprising at least magnetizable carrier beads and the toner particles. As is well known, the developer material QS is moved and mixed within the mixing chamber 46 by a mixing device such as an auger 49 in order to oppositely and triboelectrically charge such carrier beads and toner particles respectively. As a consequence of such charging, the oppositely charged toner particles adhere triboelectrically to the charged magnetizable carrier beads.

The development apparatus 40 also includes a developer material feeder assembly such as a magnetic roll 50 for feeding a quantity QF of developer material from the chamber 46 to the donor roll 42. The feeder assembly 50 includes a cylindrical substrate or shell 90 that can be made out of a general purpose polycarbonate. The shell 90 is rotatable in the direction of the arrow 98, and includes a coating 100 thereover, as well as magnetic members M1 to M4 within its core. The magnetic roller 50 and the donor roll 42 are electrically biased relative to each other so that charged toner particles within the quantity QF of developer material fed to the donor roll 42 are attracted from the magnetic roll 50 to donor roll 42.

As further shown in FIG. 1, the donor roll 42 is biased to a specific voltage, by a DC power supply 80 in order to enable donor roll 42 to attract charged toner particles off of magnetic roll 50 in a nip 82. To enhance the attraction of charged toner particles from the chamber 46, magnetic roll 50 is also biased by a DC voltage source 84. It is also biased by a AC voltage source 86 that functions to temporarily loosen the charged toner particles thereon from their adhesive and triboelectric bonds to the charged, magnetized carrier beads. Loosened as such, they can be attracted more easily to the donor roll 42. AC voltage source 86 can be applied either to a conductive layer of the magnetic roll 50 as shown in FIG. 1, or directly to the donor roll in series with the DC supply 80. Similarly as shown, an AC bias is also applied to the electrode wires 44 by an AC voltage source 88 and serves to loosen charged toner particles from the donor member 42, as well as to form a toner cloud within the development zone DZ.

Figure 2:
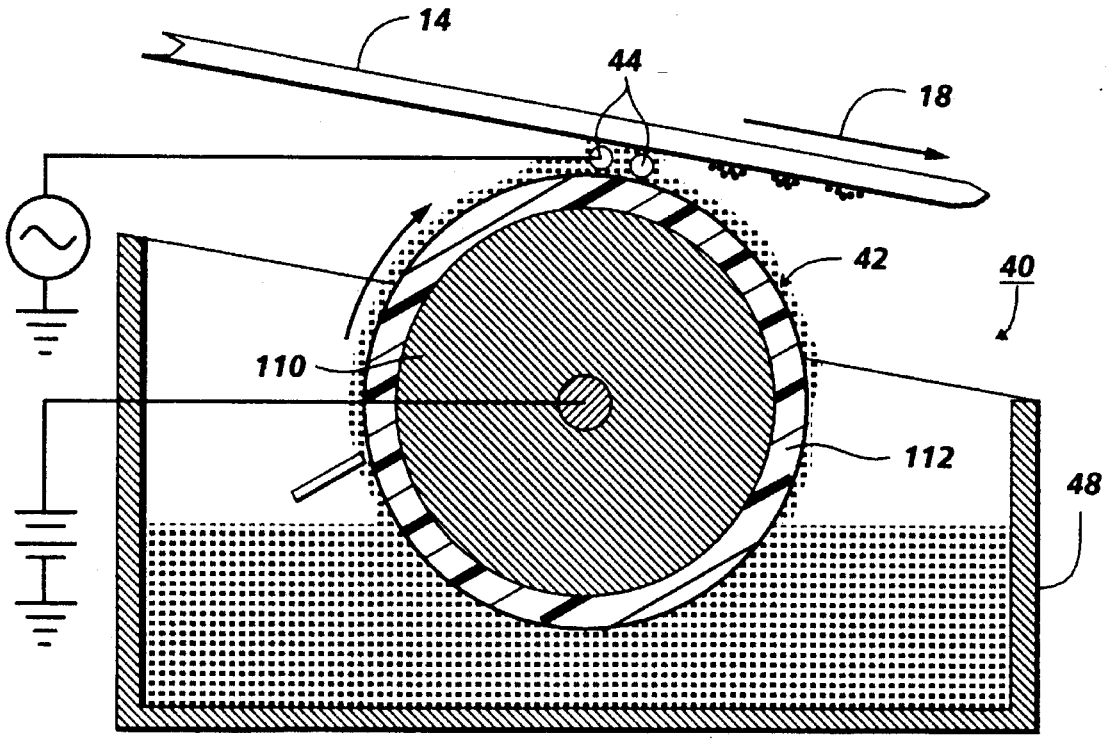
FIG. 2 is a schematic elevational view of an embodiment of a single component development apparatus including the donor roll according to the present invention.

Referring now to FIG. 2, a single-component embodiment of the development 40 is illustrated. In FIGS. 1 and 2, like reference numerals indicate like elements. As in the two component system of FIG. 1, the single-component system includes a donor roll 42 (to be described in detail below) and biased electrode wires 44. In the single component version, the donor roll 42 picks up toner particles directly from a supply of such toner particles held in a toner chamber defined by the housing 48. The donor roll 42 as shown then transports the toner particles to the development zone DZ for latent image development. In the single-component system of FIG. 2, there is therefore no developer material feeder since no carrier beads are used in the system.

According to the present invention, and referring to either FIGS. 1 or 2, the donor roll 42 includes a core 110 consisting of a conventional conductive material, such as aluminum, and an outer surface coating 112 that is made of a particular advantageous ceramic compound or composition (to be described in detail below). The use of a donor roll coated with a ceramic compound is disclosed for example in issued June 21, 1994, to Behe et. al. and commonly assigned to the assignee of this application. The contents and disclosure of U.S. Pat. No. -A-5,322,970 are hereby fully incorporated in this application. This ceramic surface coating 112 is preferably plasma sprayed onto the core 110 of donor roll 42 so as to achieve required electrical properties, as well as a thickness suitable for desired conductivity, and breakdown voltage protection.

Plasma spraying as a process generates a plasma by passing an inert gas through a high voltage electric arc. The ionized gas is forced through a nozzle where powder is introduced into the plasma stream. The powder melts and is projected at high velocities onto a substrate. Depending on the particular substrate used it may be necessary to cool the samples with air jets during the plasma spray process.

The thickness of the ceramic coating 112, for example, is preferably between 0.17 and 3.18 mm, on a donor roll 42 having a total outer diameter of approximately 25 mm. Because in plasma spraying the ceramic coating 112 can be controlled precisely, it can be thus be controlled in order to ensure that surface anomalies such as craters or pin holes are kept to a minimum. The use of a plasma spray method of applying the ceramic coating in addition results in a much more uniform periphery geometry than that obtained from other methods. Thus, grinding subsequent to plasma coating can often be eliminated. A donor having a ceramic coating surface therefore has shown no significant abrasion problems when used for an extended period of time in a development apparatus within moving contact with a developer feeder device.

Ceramic coated donor rolls can have discharge time constants from about 600 microseconds to slightly less than 60 microseconds. The use of such a donor roll in a continuous-process electrostatographic development apparatus is therefore preferable since the apparatus involves a frequent and relatively high speed charging and discharging development function. Discharge time constants as low as 60 microseconds greatly reduce discharge time and improve copying speed over similar systems with anodized aluminum donor rolls.

Ceramic is a non-metallic, inorganic compound normally comprised of a blend of any of a number of materials including for example the following: alumina, zirconia, thoria, beryllia, magnesia, spinel, silica, titania, and forsterite. Ceramics which include at least one of aluminum (AI), boron (B), carbon (C), germanlure (Ge), silicon (Si), titanium (Ti), zirconlure (Zr), magnesium (Mg), beryllium (Be) and tungsten (W) are particularly hard, highly abrasion resistive, have high resistivity, high dielectric strength, low dielectric loss, and a high dielectric constant. The testing and selection of particular combinations and compositions among the above materials for meeting cost, process, and the development process requirements of an electrostatographic process, clearly would appear unpredictable and time consuming.

According to the present invention, it has been found that a particular combination consisting essentially of alumina and titania is sufficient to produce a plasma sprayed coating on an aluminum core donor roll that satisfies the resistivity, dielectric constant, and discharge time constant requirements of the development apparatus of the present invention. Commercially, however, alumina and titania compound ceramics, which are suitable for plasma spray coating applications, are available mainly as pre-formulated powders, such as At-87 and At-60 both available from a vendor White Engineering Surfaces Corporation of Newton Pa.

Testing of several batches from this vendor showed one batch of 100% At-87 to be a powder consisting essentially of 87% Alumina and 13% Titania, by weight. More precise testing of another batch of 100% At-87 showed it to consist of 88% Alumina, 11% Titania, and about 1% of other oxides, by weight. Similarly, testing of one batch of 100% At-60 showed it to be a powder consisting essentially of about 60% Alumina and about 40% Titania, by weight, and more precise testing of another batch of AT-60 showed to consist of about 52% Alumina, about 46% Titania and about 2% other oxides. These types of ceramic powders were also selected because they are relatively finer than other possible powders. Using such finer powders produces a final coating that has a-higher theoretical density, and hence no pinholes and voids in order to provide the necessary breakdown voltage protection of greater than 2000 volts, even for a thin coating thereof.

Alumina is an excellent insulator with resistivity values of $10^{-6}$ ohm-cm at room temperature. Pure, stoichiometric titania is also used as an insulator with book values of $10^{13}$ ohm-cm at room temperature. The dielectric constants of Alumina and Titania reported at 1 MHz are about 9 and 100, respectively. An important feature of Titania is the extent to which it can be chemically reduced when exposed to temperatures in excess of 900° C. The reduction of Titania leads to significant changes in electrical conductivity. As the oxygen is lost during the plasma spray process the Ti ions move onto interstitial sites and resistivity decreases. The particular ceramic composition of the present invention was found by combining an understanding of the temperatures that are generated in the plasma spray process and knowledge of the ability to reduce Titania at high temperatures as above, thereby increasing the electrical conductivity of the resultant coating.

It has also been found that donor rolls coated with a pure At-87 ceramic compound although meeting other requirements, were too resistive, and had discharge time constants that were too slow (i.e a time constant greater than 600 microseconds). Pure At-87 was therefore not acceptable for purposes of the present invention.

On the other hand, donor rolls coated with a pure At-60 ceramic compound although meeting other requirements, were generally too conductive, and the discharge time constants were relatively too fast.

Through formulation and testing of various non-commercially available ratios of Alumina and Titania, it has been found according to the present invention that donor rolls coated with a ceramic compound consisting of 85%– 88% Alumina ($Al_2O_3$) and 13%–14.5% Titania ($TiO_2$), by weight, effectively and additionally meet the resistivity and discharge time constant requirements for the development apparatus of the present invention. As can be seen from FIG. 4, these ranges are particularly suitable for values of AT-87 and AT-60 corrected or normalized to the actual weights in the composition, without an effect from the 1–2% of other oxides. Preferably, the ceramic compound of the present invention consists of about 86% Alumina and about 13.75% Titania, by weight. This preferred ratio of the powders chosen for the coating was found by empirical methods. By using fused and crushed, off-the-shelf powders we were able to mix appropriate amounts of two different prepared batches to achieve our coating.

As illustrated in FIGS. 3 and 4, this particular ratio was achieved for example by using 93% of a typical batch of At-87 and 7% of a typical batch of At-60 powders from the above mentioned vendor. Other percentages around the 93% and 7% combinations can of course be used, since both powders include Alumina and Titania. However, in the final composition, it is believed that the percentage of Titania of 13%–14.5% is more critical or more sensitive with respect to the desired resistivity and time constant requirements. Accordingly, the approach will be to seek to achieve this, and then to make up the balance with Alumina and the approximately 1–2% other oxides. FIGS. 3 and 4 show mathematically calculated results for various percentage combinations of AT-87 and AT-60 for two typical bathes with slightly varying contents of Alumina and Titania as shown.

Figure 5:
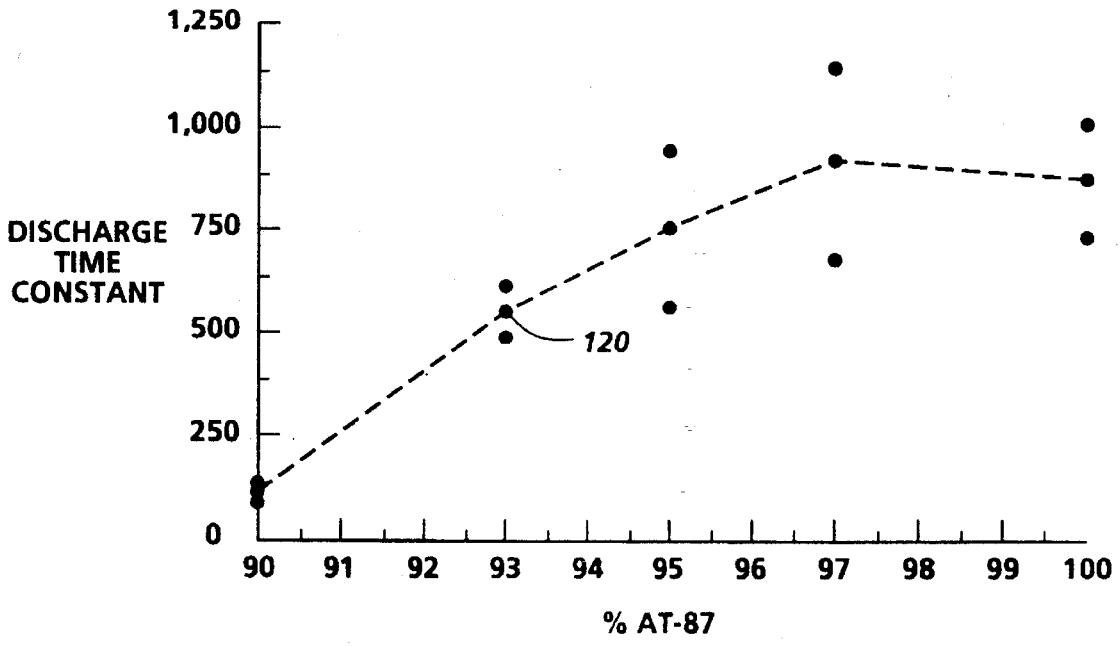
FIG. 5 is a plot of measured discharged time constant values for the various percentage compositions obtained as in FIGS. 3 and 4.
Figure 6:
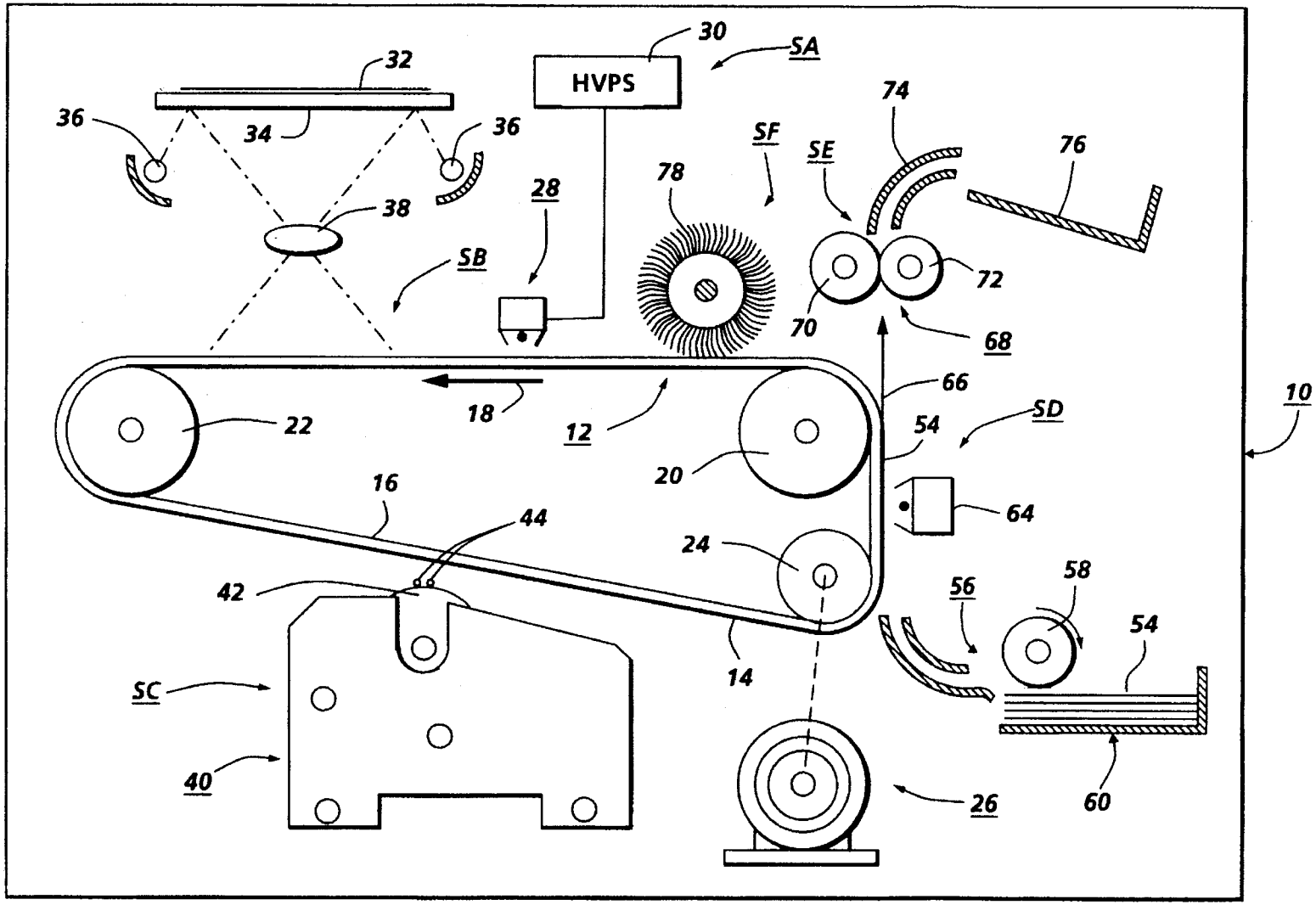
FIG. 6 is a schematic elevational view of an illustrative image-on-image electrostatographic printing machine incorporating a development apparatus according to the present invention.

FIG. 5 shows a plot of various such ceramic formulation versus oscilloscope measured discharged time constants for each. The preferred range of discharge time constants for the development apparatus 40 according to the present invention is between 60 and 600 microseconds when measured with an oscilloscope. Note that the discharge time constant for the 93% At-87 sample shown as 120 is about 550 microseconds. This value of time constant is obtained for rolls coated with a composition having a dielectric constant within a range of 16–24, and a resistivity of $2.8\times10^7$–$4.2\times10^8$ ohm-cm at room temperature. The time above was obtained by monitoring a decay of a 100 volt pulse impressed on the coated roll using an oscilloscope.

It was also found however, that a static response method (RxC method) of measuring the time constant of the same coated roll, produces different results, where R is the resistivity, and C the capacitance as follows.

$$\begin{aligned}\text{Time constant} &= R\times C\\ &= rho\times K\times E_0\end{aligned}$$

where $rho$ = volume resistivity
$K$ = dielectric constant
$E_0$ = permittivity of free space.

The static response method as such can be used (in manufacturing) on a manufacturing floor to measure the time constant of the composition coated roll. For example, where K is 16–24 as above, $E_O$ is $8.85\times10^{-14}$ farads/cm, time constant values obtained for coated rolls according to the present invention having a resistivity (rho) of $1.4\times10^8$–$2.1\times10^9$ ohm-cm at room temperature, were found by this method to fall within a range of 300–3000 microseconds. The time constant values obtained in this manner may however be corrected appropriately to reconcile them with those obtained using oscilloscope measurements. It is clear either way that time constant value results are dependent on the resistivity of the resulting coating composition, and on the method of measurement. It is believed however, that for K=16–24 as above, and $E_O=8.85\times10^{-14}$ farads/cm, ceramic rolls coate and Titania as above to have a dielectric constant within a range of 16–24, and a resistivity within a range of $2.8\times10^7$–$2.1\times10^9$ ohm-cm at room temperature, will produce acceptable discharge time constant values, measured either.

The particular preferred ratio of AT-87 and AT-60 powders was prepared for plasma spraying by a method that blends appropriate amounts of the required powders, and melts or fuses them together. The powders are then crushed, milled, and sieved.

To recapitulate, there has been disclosed according to the present invention, a development apparatus including a toner transport roll having a conductive core and a ceramic outer surface coating for transporting toner particles into a development transfer relationship with a latent image. The ceramic coating of the donor roll consists essentially of a Combination of Alumina and Titania, preferably about 85%–88% alumina ($Al_2O_3$) and at least 13%–14.5% .Titania ($TiO_2$), by weight. More precisely the ceramic coating preferably consists essentially of about 86% Alumina and about 13.75% Titania, by weight. When the ceramic coating is plasma sprayed as above, the donor roll according to the present invention desirably has an oscilloscope-measured discharge time constant of about 550 microseconds, a resistivity within a range of $2.8\times10$–$2.1\times10^9$ (ohm-cm) at room temperature, and a dielectric constant within a range of 16–24 at 100 KHz.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A toner donor roll for use in a development apparatus, the donor roll comprising:

(a) a conductive core; and (b) a ceramic outer coating over said-conductive core, said ceramic coating consisting essentially of a mixture of alumina and titania by weight, for giving the toner transport donor roll a desired resistivity within a range of $2.8\times10^7$–$2.1.0\times10^9$ (Ohm-cm), and a dielectric constant within a range of 16–24 at 100. KHz.

2. A developer material transport roll comprising:

(a) a core; and (b) a ceramic coating over said core, said ceramic coating comprising 85%–88% Alumina and at least 13% Titania by weight for giving the developer material transport roll a desired resistivity within a range of $2.8\times10^7$–$2.1.0\times10^9$ (Ohm-cm), and a discharge time constant of about 550 microseconds measured with an oscilloscope.

3. The developer material transport roll of claim 2, wherein said ceramic coating comprises 13%–14.5% Titania and about 86% Alumina, by weight.

4. The developer material transport roll of claim 2, wherein said ceramic coating comprises about 86% Alumina and about 13.75% Titania, byweight.

5. The developer material transport roll of claim 2, wherein said ceramic coating is plasma sprayed onto said core, and has a dielectric constant within a range of 16–24 at 100. KHz.

6. The developer material transfer roll of claim 5, wherein said ceramic coating further comprises 1–2% other oxides.

7. The developer material transfer roll of claim 5, wherein said ceramic coating has a breakdown voltage of at least 2000 volts.

8. The developer material transfer roll of claim 5, wherein said ceramic coating of said donor roll has an oscilloscope-measured discharge time constant of less than 600 microseconds.

9. The developer material transfer roll of claim 8, wherein said ceramic coating has an oscilloscope-measured discharge time constant of 550 microseconds.

10. An apparatus for developing a latent electrostatic image on a surface, the apparatus comprising:

(a) a housing defining a chamber storing developer material containing toner particles;

(b) means mounted partially within said chamber for moving said developer material; and (c) a rotatable donor roll for transporting toner particles into a development transfer relationship with the latent electrostatic image on the surface, said donor roll being mounted in a toner particle receiving relationship with said developer material moving means, said donor roll including a core, and a ceramic outer coating, and said ceramic coating consisting of 85%–88% Alumina ($Al_2O_3$) and 13%–14.5% Titania ($TiO_2$), by weight.

11. The apparatus of claim 10, including biased electrodes located between said donor roll and the latent electrostatic image for creating a toner cloud of toner particles transported thereto by said donor roll.

12. The apparatus of claim 10, wherein said ceramic outer coating is plasma sprayed onto said core, and has an oscilloscope-measured discharge time constant of about 550 microseconds.

13. A toner donor roll for use in a development apparatus, the donor roll comprising:

(a) a conductive core; and (b) a ceramic outer coating over said conductive core, said ceramic coating consisting essentially of a mixture of alumina and titania by weight, for giving the toner transport donor roll a desired resistivity within a range of $2.8\times10^7$– $2.1\times10^9$ (Ohm-cm), a dielectric constant within a range of 16–24 at 100. KHz and an oscilloscope-measured discharge time constant within a range of 60–600 microseconds.

14. A printing machine comprising:

(a) an image bearing surface;

(b) means for electrostatically forming a latent image on said image bearing surface; and (c) a development apparatus for developing the latent electrostatic image, the development apparatus including:

(i) a housing defining a chamber storing developer material containing toner particles;

(ii) means mounted partially within said chamber for moving said developer material; and (iii) a rotatable donor roll for transporting toner particles into a development transfer relationship with the latent electrostatic image on the image bearing surface, said donor roll being mounted in a toner particle receiving relationship with said developer material moving means, said donor roll including a core, and a ceramic outer coating, and said ceramic outer coating consisting essentially of 85%–88% Alumina ($Al_2O_3$) and 13%–14.5% Titania ($TiO_2$), by weight.

* * * * *

UNITED STATES PATENT AND TRADEMARK OFFICE

CERTIFICATE OF CORRECTION

PATENT NO. : 5,473,418

DATED : December 5, 1995

INVENTOR(S) : Ann M. Kazakos et al.

It is certified that error appears in the above--identified patent and that said Letters Patent is hereby corrected as shown below:

Column 8, line 32, delete $10^{-6}$ and insert --$10^{16}$--.

Signed and Sealed this

Sixteenth Day of July, 1996

*Attest:*

Bruce Lehman

BRUCE LEHMAN

*Attesting Officer*

*Commissioner of Patents and Trademarks*